US007487734B2

(12) United States Patent
Davis

(10) Patent No.: US 7,487,734 B2
(45) Date of Patent: Feb. 10, 2009

(54) CONVERTIBLE MULTIPURPOSE RECREATIONAL ASSEMBLY

(76) Inventor: Terrance G. Davis, 4731 Crosley Ave., Duluth, MN (US) 55804

( * ) Notice: Subject to any disclaimer, the term of this patent is extended or adjusted under 35 U.S.C. 154(b) by 0 days.

(21) Appl. No.: 11/363,782

(22) Filed: Feb. 28, 2006

(65) Prior Publication Data

US 2007/0199498 A1 Aug. 30, 2007

(51) Int. Cl.
*B63B 1/00* (2006.01)

(52) U.S. Cl. ..... 114/61.1; 114/343; 114/344; 296/157; 296/35.3

(58) Field of Classification Search ..... 280/414.1, 280/414.2; 114/344, 77 R, 77 A, 61.1, 343, 114/364, 259; 414/536, 529; 43/4; 296/35.3, 296/156, 157

See application file for complete search history.

(56) References Cited

U.S. PATENT DOCUMENTS

| | | | | | |
|---|---|---|---|---|---|
| 1,151,420 | A | * | 8/1915 | Thompson | 114/77 A |
| 3,719,244 | A | * | 3/1973 | Miller et al. | 180/14.1 |
| 3,719,384 | A | | 3/1973 | du Bois | |
| 3,731,644 | A | * | 5/1973 | Bradt | 114/61.1 |
| 3,807,338 | A | * | 4/1974 | Shader | 114/60 |
| 3,828,379 | A | | 8/1974 | Walston | |
| 3,860,982 | A | | 1/1975 | Rumsey | |
| 4,165,117 | A | | 8/1979 | Kaiser | |
| 4,801,153 | A | * | 1/1989 | Wilson | 280/414.1 |
| 5,653,494 | A | | 8/1997 | Cleall et al. | |
| 5,772,388 | A | * | 6/1998 | Clark | 414/484 |
| 6,102,468 | A | | 8/2000 | Lowrey et al. | |
| 6,135,700 | A | * | 10/2000 | Collins | 414/476 |
| 6,283,537 | B1 | | 9/2001 | De Vore, III | |
| 6,669,269 | B1 | | 12/2003 | Tran-Ngoc | |
| 6,719,317 | B1 | * | 4/2004 | Grovender et al. | 280/414.1 |
| 2003/0184055 | A1 | | 10/2003 | Badger et al. | |

* cited by examiner

*Primary Examiner*—Ed Swinehart
(74) *Attorney, Agent, or Firm*—Kinney & Lange, P.A.

(57) ABSTRACT

A multipurpose recreational assembly comprises a first module having a top side and a bottom side, a first pair of channel members each having a first side and a second side, a first pair of guide members, and a second module having a top side and a bottom side. The first pair of channel members is mounted to and extends longitudinally along the top side of the first module. The first pair of guide members is attached to the bottom side of the second module, and couples with the first pair of channel members. A plurality of rollers may be positioned between the first side and the second side of the first pair of channel members to allow the first pair of guide members to roll along a longitudinal length of the first pair of channel members.

21 Claims, 11 Drawing Sheets

CONVERTIBLE MULTIPURPOSE RECREATIONAL ASSEMBLY

BACKGROUND OF THE INVENTION

The present invention relates generally to recreational assemblies for use in recreational activities. More particularly, the present invention relates to a modular multipurpose recreational assembly with a mounting system that allows easy conversion between numerous recreational uses.

Recreational activities such as boating, camping, and snowmobiling have become popular ways to enjoy the outdoors. It is common for an individual or a family to own several different recreational devices. For instance, an individual may own both a boat as well as a camper trailer. However, along with owning several recreational devices comes the hardship of storing those devices when they are not in use. The majority of people do not have space in their garage to store, for instance, a boat on a trailer, a camper trailer, a utility trailer, and a snowmobile trailer.

In the past, many individuals had to be selective in the recreational devices they chose to purchase because these devices were generally adapted for one use, i.e., transporting snowmobiles, transporting a boat, or for camping. Thus, it was not feasible for the average person to buy and store numerous recreational devices. Besides the storage difficulties, many individuals have been deterred from buying several separate recreational devices due to the fact that one vehicle cannot typically transport more than one of these devices simultaneously. As a result, separate vehicles are required for transportation, which quite often is not a desirable or feasible option.

Thus, there exists a need for a multipurpose recreational assembly that is transportable by a single vehicle and easily convertible into numerous recreational devices.

SUMMARY OF THE INVENTION

The present invention is a multipurpose recreational assembly comprising a first module having a top side and a bottom side, a first pair of channel members each having a first side and a second side, a first pair of guide members, and a second module having a top side and a bottom side. The first pair of channel members is mounted to and extends longitudinally along the top side of the first module. The first pair of guide members is attached to the bottom side of the second module, and couples with the first pair of channel members. A plurality of rollers may be positioned between the first side and the second side of the first pair of channel members to allow the first pair of guide members to roll along a longitudinal length of the first pair of channel members.

DETAILED DESCRIPTION

Figure 1:
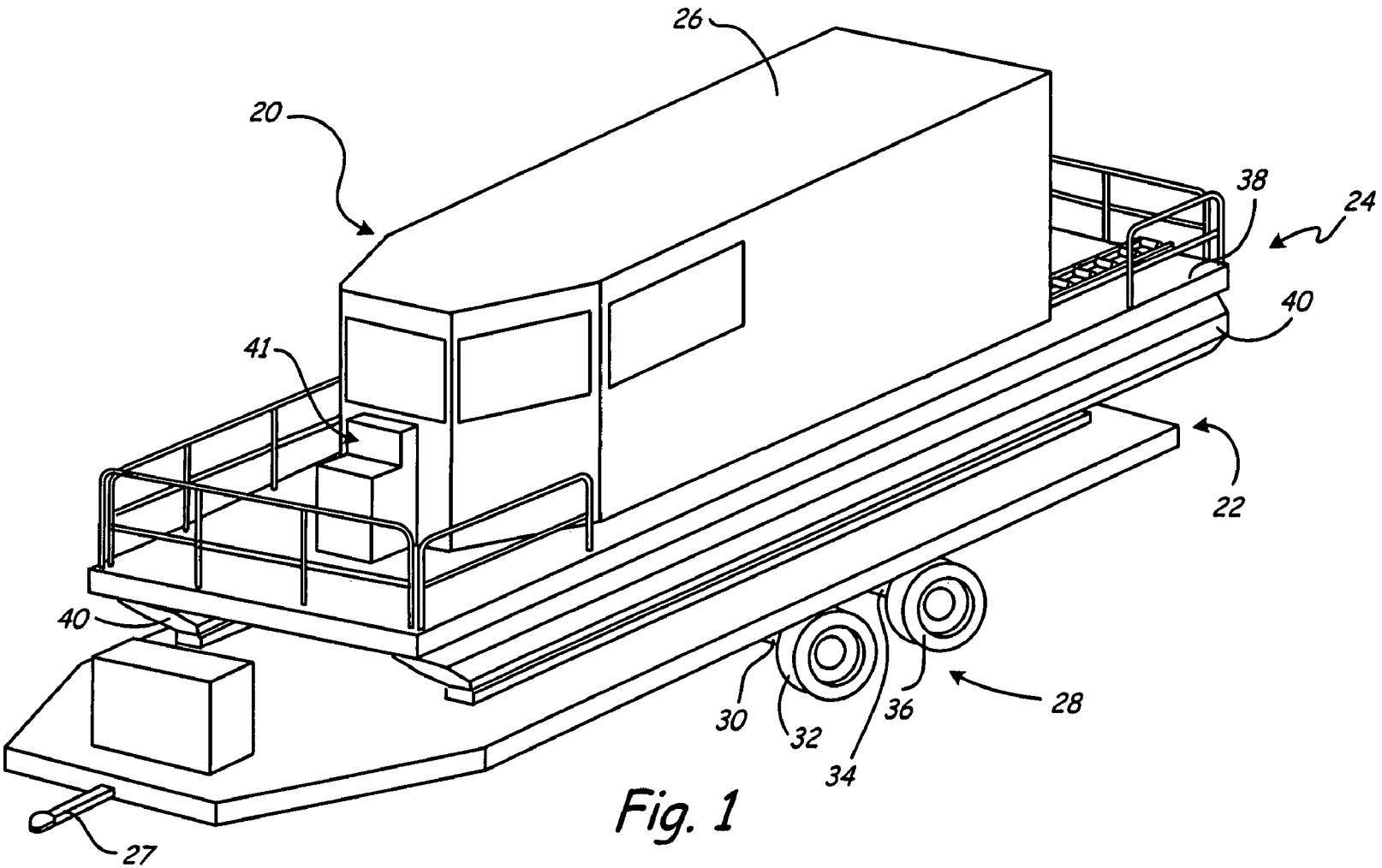
FIG. 1 is a perspective view of a representative embodiment of a multipurpose recreational assembly.

FIG. 1 is a perspective view of a preferred embodiment of multipurpose recreational assembly 20, which includes a plurality of modules, including trailer module 22, pontoon module 24, and camper module 26. Multipurpose recreational assembly 20 uses various combinations of these modules to vary the intended use of the assembly. Thus, trailer module 22, pontoon module 24, and camper module 26 may all be detached from one another and rearranged in various configurations. More particularly, camper module 26 is slidably coupled to pontoon module 24, which is slidably coupled to trailer module 22.

Multipurpose recreational assembly 20 is configured to be transported behind a vehicle by means of trailer hitch 27 and wheel assembly 28 mounted to trailer module 22. In a preferred embodiment, wheel assembly 28 includes first axle 30, first set of wheels 32, second axle 34, and second set of wheels 36. In other embodiments, wheel assembly 28 includes only first axle 30 and first set of wheels 32. Trailer hitch 27 is mountable on a standard hitch ball mount attached to a vehicle. Once mounted, the vehicle can tow multipurpose recreational assembly 20 to a desired location.

In the embodiment shown in FIG. 1, pontoon module 24 further includes pontoon platform 38 and flotation members 40. Flotation members 40 allow pontoon module 24 to float in a body of water when pontoon module 24 is detached from trailer module 22. In alternative embodiments, pontoon module 24 may include more than two flotation members. Furthermore, in other embodiments, pontoon module 24 may comprise one large flotation member. Consequently, a pontoon module with any number of flotation members is within the intended scope of this invention.

As shown in FIG. 1, pontoon module 24 also includes motor control assembly 41 coupled to pontoon platform 38. As will be discussed in more detail later, when camper module 26 is positioned on top of pontoon module 24, motor control assembly 41 may be operated from an interior of camper module 26.

Figure 2:
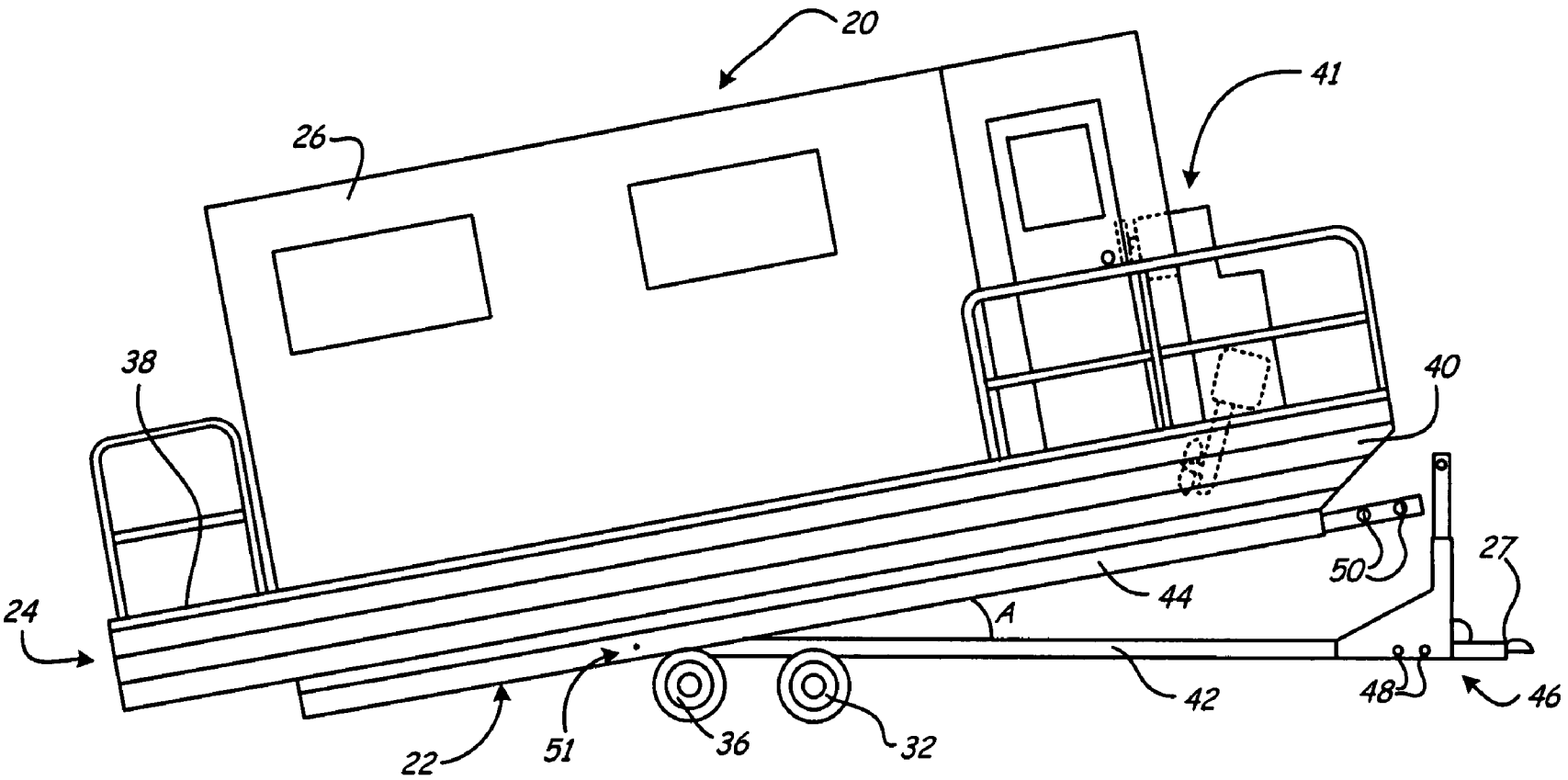
FIG. 2 is a side view of the multipurpose recreational assembly showing a tilt function.

FIG. 2 is a side view of multipurpose recreational assembly 20 showing a tilt function of trailer module 22. The tilt function provides an easier and more efficient means for loading or unloading pontoon module 24 or camper module 26 from multipurpose recreational assembly 20. Trailer module 22 further includes frame 42, trailer platform 44, and latching device 46. Latching device 46 comprises a pair of pins (not shown), pin apertures 48 in frame 42, and corresponding pin apertures 50 in trailer platform 44. As shown in FIG. 2, trailer platform 44 is configured to tilt with respect to frame 42, thereby creating angle A.

While multipurpose recreational assembly 20 is being transported or stored, the tilt function of trailer module 22 is not in use. In that configuration, trailer frame 42 and trailer platform 44 are substantially parallel, and pin apertures 48 match-up with pin apertures 50. Inserting the pair of pins through pin apertures 48 and 50 secures trailer platform 44 to frame 42, resulting in an angle A of zero degrees. To utilize the tilt function in the preferred embodiment, an operator removes the pair of pins from corresponding pin apertures 48 and 50. Once the pair of pins is removed, hinge assembly 51 allows trailer platform 44 to tilt with respect to frame 42, creating angle A.

Furthermore, FIG. 2 also shows a more detailed view of motor control assembly 41 coupled to pontoon platform 38. In particular, motor control assembly 41 includes a motor and a steering wheel, which are indicated by broken lines. The steering wheel is configured to protrude into the interior of camper module 26 to provide an enclosed driving position, while the motor is extendable in a downward direction between flotation members 40 to propel pontoon module 24 when placed in a body of water.

Figure 3:
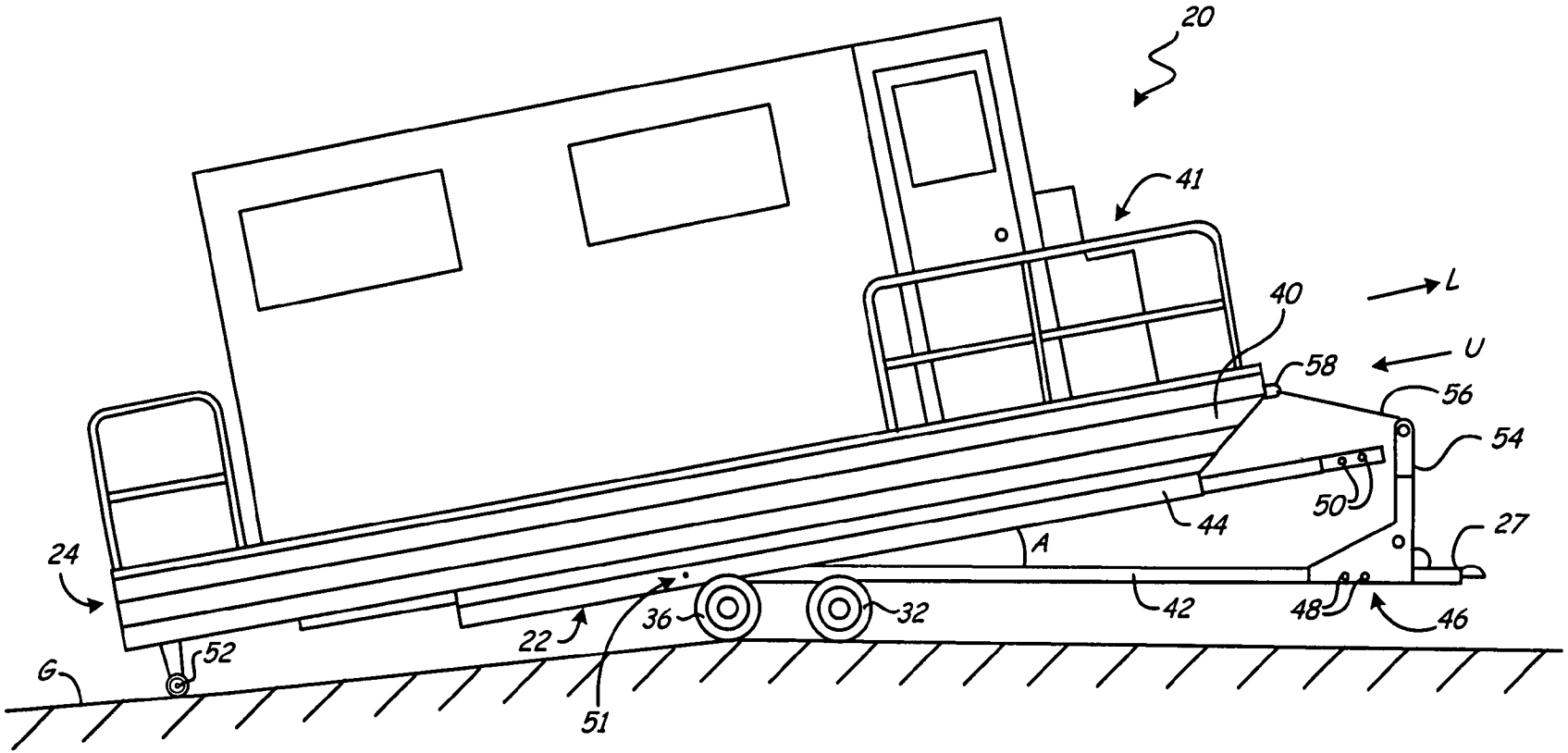
FIG. 3 is a side view of the multipurpose recreational assembly showing the removal of a pontoon module from a trailer module.

FIG. 3 is a side view of multipurpose recreational assembly 10 showing the removal of pontoon module 24 with attached camper module 26 from trailer module 22. As stated previously, camper module 26 is slidably coupled to pontoon module 24, which is slidably coupled to trailer module 22. This slidable connection allows pontoon module 24 to be unloaded from trailer module 22 when desired in order to create an alternative configuration of multipurpose recreational assembly 20.

In order to unload pontoon module 24 from trailer module 22, the operator first tilts trailer platform 44 with respect to frame 42 in order to lower a back end of pontoon module 24 closer to ground surface G. To aid in unloading pontoon module 24, retractable wheel assembly 52 secured to a bottom side of pontoon platform 38 may be extended in a downward direction as shown in FIG. 3. During the unloading process, retractable wheel assembly 52 contacts ground surface G and is configured to roll in a direction away from trailer module 22 to assist in unloading pontoon module 24.

Multipurpose recreational assembly 20 further includes winch 54 coupled to a front end of trailer module 22. Winch 54 includes cable 56 attachable to cable connector 58 on a front end of pontoon module 24. When unloading pontoon module 24, cable 56 unwinds from winch 54, thereby causing pontoon module 24 to slide off of trailer module 22 in direction U.

Conversely, to load pontoon module 24 onto trailer module 22, the operator first tilts trailer platform 44 with respect to frame 42 by removing the pair of pins from pin apertures 48 and 50. Then, cable 56 of winch 54 is attached to cable connector 58. As winch 54 winds cable 56, pontoon module 24 is pulled in a direction L, which is opposite direction U. The pulling motion caused by winch 54 allows pontoon module 24 to slide longitudinally along trailer platform 44 until it is once again loaded onto trailer module 22.

Figure 4A:
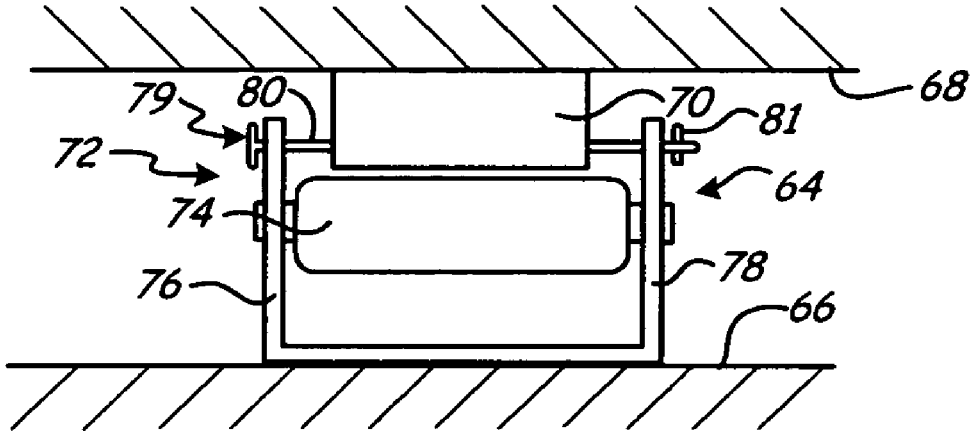
FIG. 4A is a rear view of a representative embodiment of a rolling mount device.

FIG. 4A is a rear view of a representative embodiment of rolling mount device 64, which is disposed between first module 66 and second module 68. Rolling mount device 64 comprises guide member 70, channel member 72, and plurality of rollers 74. Channel member 72 and guide member 70 extend along a longitudinal length of first module 66 and second module 68, respectively. Furthermore, channel member 72 includes first side 76 and second side 78. Rollers 74 are positioned longitudinally along channel member 72 between first side 76 and second side 78.

Figure 4B:
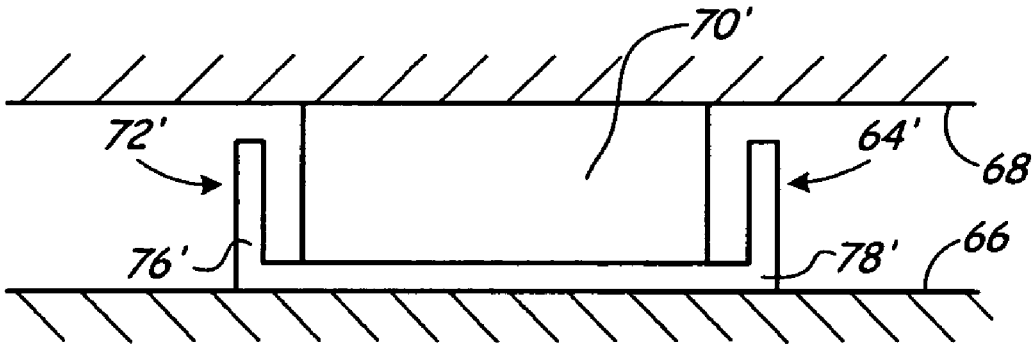
FIG. 4B is a rear view of an alternative embodiment of a mounting device.

In an alternative embodiment shown in FIG. 4B, rollers 74 are omitted from mounting device 64'. Instead, guide member 70' couples with and is slidable along channel member 72' between first side 76' and second side 78'.

In the embodiment shown in FIG. 4A, rolling mount device 64 has several functions. First, rolling mount device 64 serves as a guide when loading or unloading second module 68 from first module 66. In particular, rolling mount device 64 provides a predetermined path for second module 68 on top of first module 66. Second, rolling mount device 64 provides a reduced amount of friction, as will be discussed below with reference to FIG. 5.

As shown in FIG. 4A, rolling mount device 64 may also include locking means 79 configured to prevent movement of guide member 70 relative to channel member 72 once second module 68 is properly positioned on top of first module 66. In particular, locking means 79 prevents second module 68 from inadvertently rolling off of first module 66 during transportation or storage. In the embodiment shown in FIG. 4A, locking means 79 comprises rod member 80 and pin 81. Rod member 80 is configured to be inserted through a series of matching apertures in channel member 72 and guide member 70. Once inserted through the apertures, an end of rod member 80 is configured to receive pin 81. Pin 81 ensures that rod member 80 remains positioned within the series of apertures. Although locking means 79 has been described above as including rod member 80 and pin 81, it should be understood that other means for preventing movement of guide member 70 relative to channel member 72 may be used. For example, in another embodiment, locking means 79 may comprise a chain binder.

Figure 5:
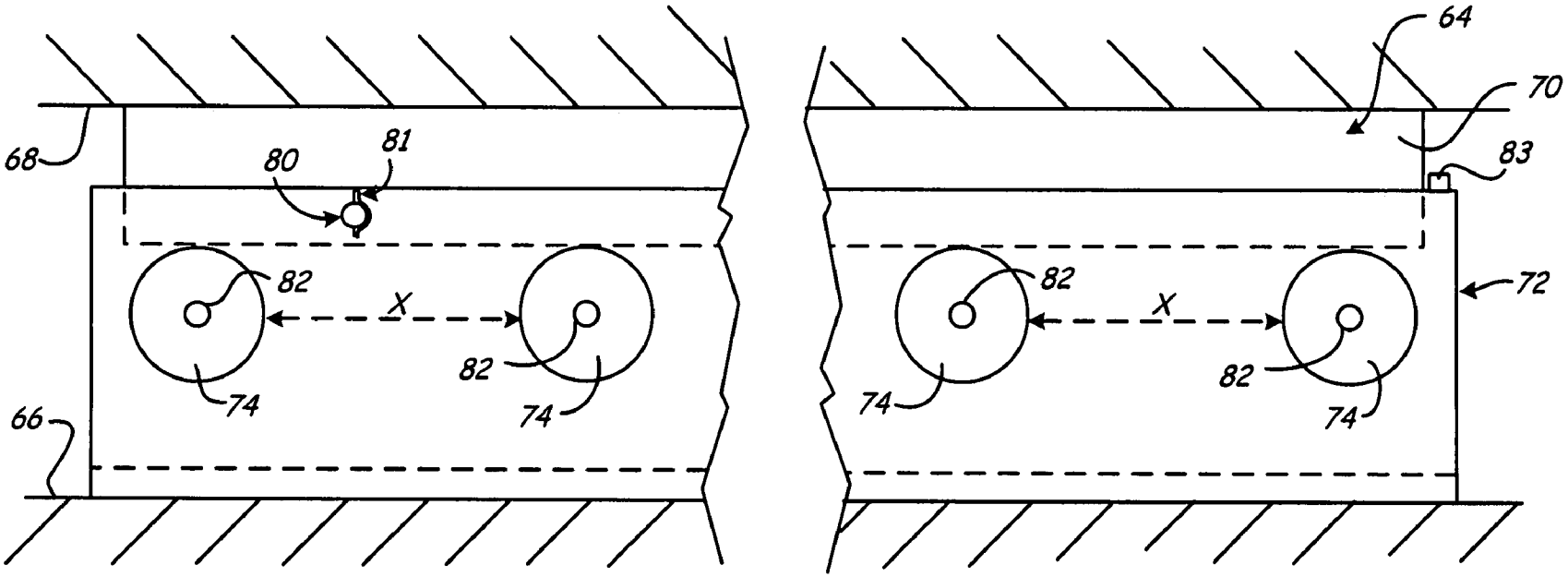
FIG. 5 is a side view of the rolling mount device.

FIG. 5 is a side view of rolling mount device 64. In FIG. 5, channel member 72 extends longitudinally along first module 66, while guide member 70 extends longitudinally along second module 68. Rollers 74 are positioned longitudinally along channel member 72 and are spaced apart by a distance X. In a preferred embodiment, X is between 12 and 14 inches, although any distance X will work so long as rollers 74 have sufficient space to rotate clockwise and counter-clockwise about roller axles 82. However, because rollers 74 provide support for guide member 70 when second module 68 is stacked on top of first module 66, the number of rollers required will depend in part on their strength and the amount of weight they must support.

Without rollers 74, guide member 70 would slide directly on an inner surface of channel member 72. While it is possible to slide guide member 70 along channel member 72, the pulling force of winch 54 must overcome a resistive force of sliding friction acting in an opposite direction in order to move second module 68. This resistive force of friction is the result of two solid objects being in contact, and increases as the weight of second module 68 increases. However, placing rollers 74 between guide member 70 and channel member 72 reduces friction and makes movement of second module 68 much easier. This results from the fact that the magnitude of rolling friction is much less than sliding friction. Therefore, while rollers 74 are not essential to the operation of this invention, they are used to reduce friction and make loading and unloading of the various modules smoother and easier.

As shown in FIG. 5, rolling mount device 64 further includes sensor 83. Sensor 83 is preferably a pushbutton or an optical type sensor that is triggered once guide member 70 of second module 68 reaches a specified point along channel member 72. Sensor 83 is coupled to winch 54, and is configured to send a signal telling winch 54 to cease winding cable 56. Thus, sensor 83 ensures that winch 54 does not pull second module 68 too far along channel member 72 during the loading process.

Figure 6:
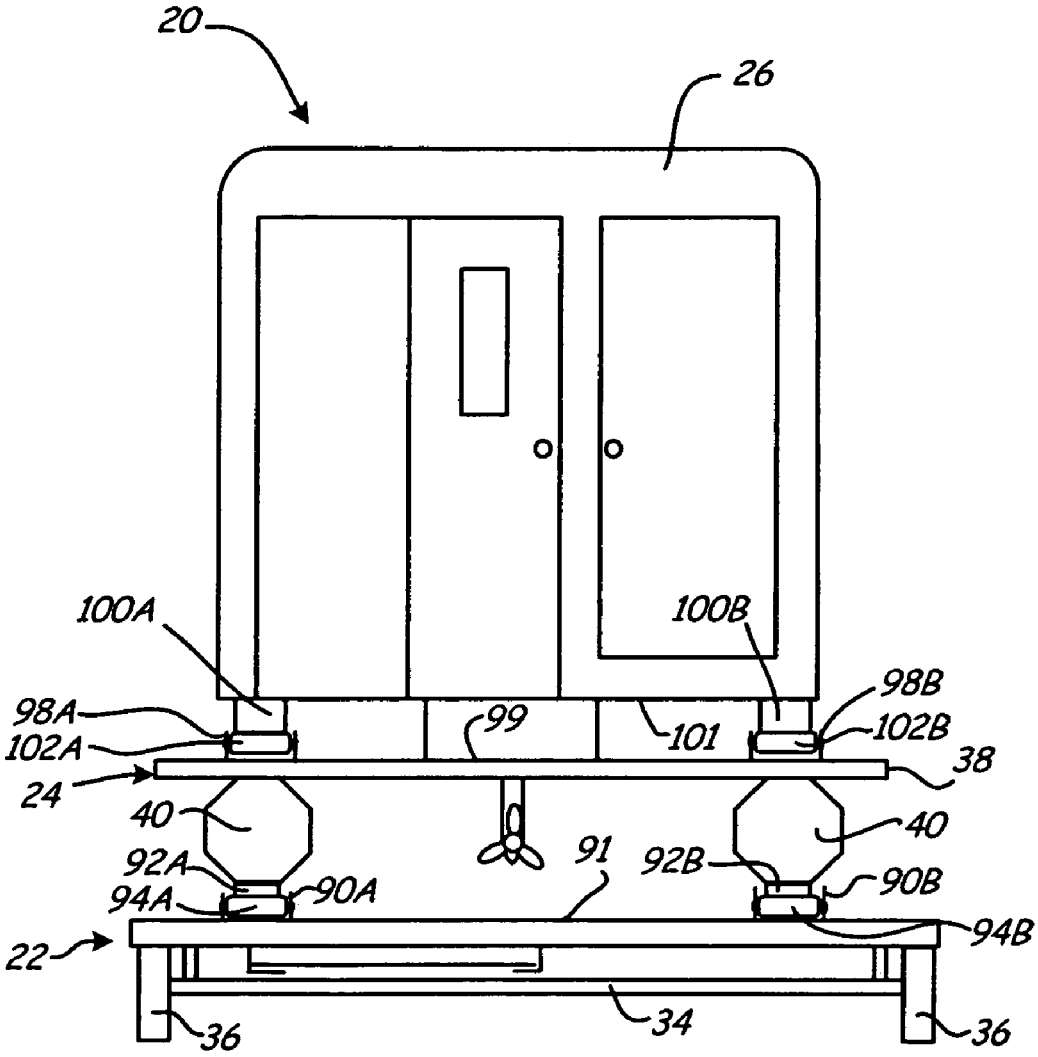
FIG. 6 is a rear view of the multipurpose recreational assembly of FIG. 1.

FIG. 6 is a rear view of multipurpose recreational assembly 20. As shown in FIG. 6, two rolling mount devices are disposed between trailer module 22 and pontoon module 24, as well as between pontoon module 24 and camper module 26.

In particular, a first pair of rolling mount devices slidably couples pontoon module 24 with trailer module 22. The first pair of rolling mount devices comprises first pair of channel members 90A and 90B attached to top side 91 of trailer module 22, first pair of guide members 92A and 92B attached to flotation members 40, and first plurality of rollers 94A and 94B extending longitudinally along first pair of channel members 90A and 90B. First plurality of rollers 94A and 94B are configured to allow first pair of guide members 92A and 92B to roll longitudinally along first pair of channel members 90A and 90B to load or unload pontoon module 24 from trailer module 22.

In addition, a second pair of rolling mount devices slidably couples camper module 26 with pontoon module 24. The second pair of rolling mount devices comprises second pair of channel members 98A and 98B attached to top side 99 of pontoon module 24, second pair of guide members 100A and 100B attached to bottom side 101 of camper module 26, and second plurality of rollers 102A and 102B extending longitudinally along second pair of channel members 98A and 98B. Second plurality of rollers 102A and 102B are configured to allow second pair of guide members 100A and 100B to roll longitudinally along second pair of channel members 98A and 98B to load or unload camper module 26 from pontoon module 24.

The first and second pairs of rolling mount devices make it possible to stack multipurpose recreational assembly modules on top of one another to create a multitude of different recreational configurations. In addition, the rolling mount devices allow, for example, the operator to easily unload camper module 26 from pontoon module 24 by rolling second pair of guide members 100A and 100B longitudinally along rollers 102A and 102B of second pair of channel members 98A and 98B.

In the preferred embodiment, first pair of channel members 90A and 90B and second pair of channel members 102A and 102B are steel "C" channels welded to top side 91 of trailer module 22 and top side 99 of pontoon module 24, respectively. Furthermore, first pair of guide members 92A and 92B and second pair of guide members 100A and 100B are preferably steel bars with a rectangular or square cross-section, and are welded to flotation members 40 and bottom side 101 of camper module 26, respectively. The guide members preferably have a width that is slightly smaller than a width of their corresponding channel members so that the guide members slide smoothly within the channel members. In other embodiments, the guide members and channel members may comprise various other metals, and may be attached to a module by means such as screws or rivets.

Although the preferred embodiment has been described in FIG. 6 as including trailer module 22, pontoon module 24, and camper module 26, additional recreational modules may be added to multipurpose recreational assembly 20. Each additional module is preferably coupled to multipurpose recreational assembly 20 with a pair of the rolling mount devices shown and described in FIG. 6. However, multipurpose recreational assemblies that incorporate a larger number of rolling mount devices disposed between two modules are possible and within the intended scope of this invention.

Figure 7:
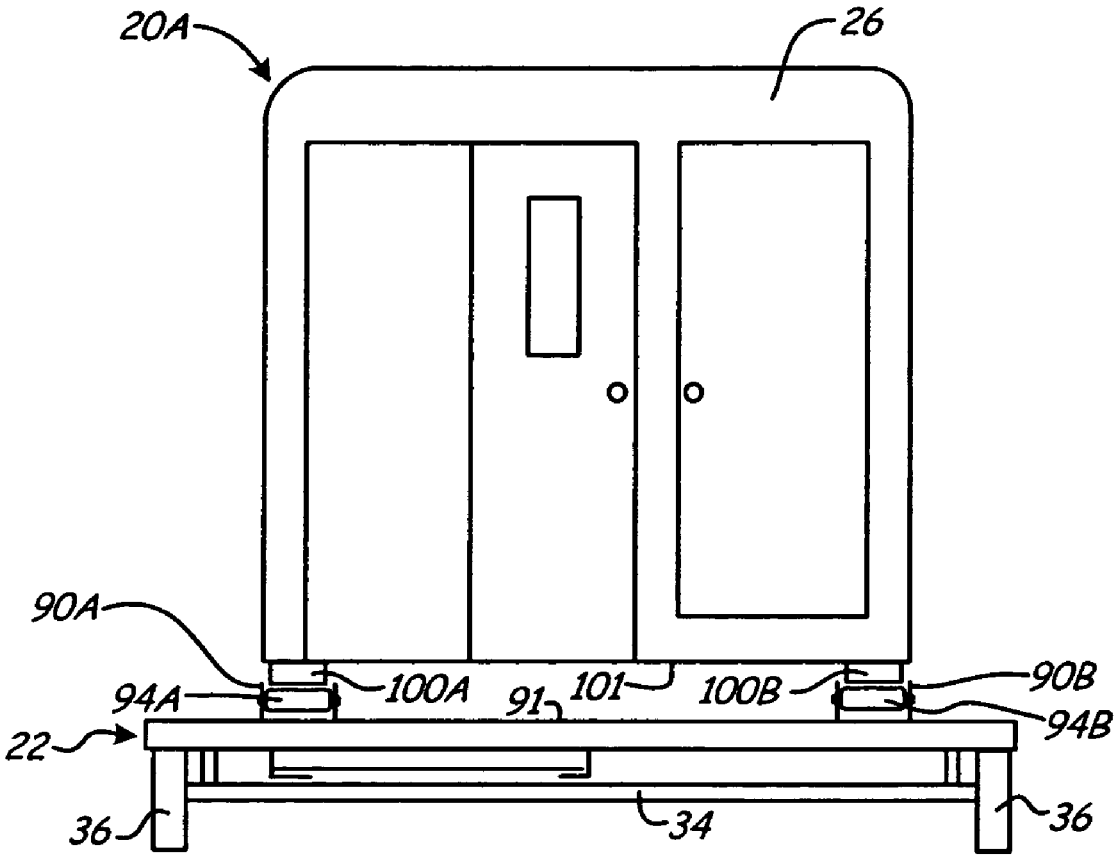
FIG. 7 is a rear view of the multipurpose recreational assembly transformed into a camper configuration.

FIG. 7 is a rear view of the multipurpose recreational assembly of the present invention transformed into a camper configuration. In particular, multipurpose recreational assembly 20A represents the embodiment of FIG. 1 with pontoon module 24 omitted. As shown in FIG. 7, a pair of rolling mount devices slidably couples trailer module 22 directly with camper module 26. The pair of rolling mount devices includes pair of channel members 90A and 90B attached to top side 91 of trailer module 22, and pair of guide members 100A and 100B attached to bottom side 101 of camper module 26. Pair of guide members 100A and 100B are supported by and configured to roll along pair of rollers 94A and 94B.

In the camper configuration, multipurpose recreational assembly 20A acts as a transportable sleeping and living quarters that is configured to be towed behind a vehicle. Multipurpose recreational assembly 20A may be parked at a destination, or camper module 26 may be unloaded and separated from trailer module 22. When multipurpose recreational assembly 20A is separated, camper module 26 is usable as a living quarters, while trailer module 22 is usable as a means for hauling or transporting other items.

Figure 8:
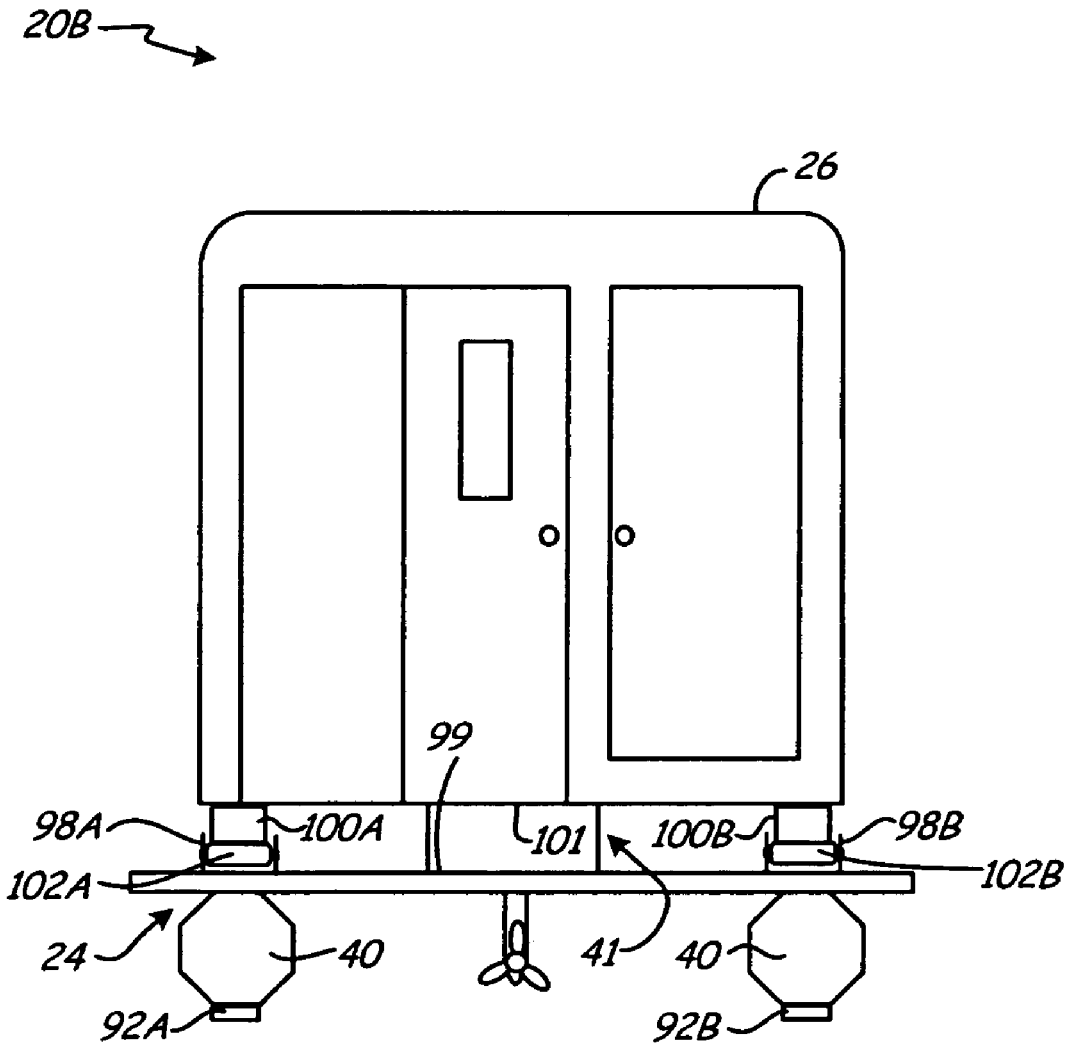
FIG. 8 is a rear view of the multipurpose recreational assembly transformed into a houseboat configuration.

FIG. 8 is a rear view of the multipurpose recreational assembly of the present invention transformed into a houseboat configuration. In particular, multipurpose recreational assembly 20B represents the embodiment of FIG. 1 with trailer module 22 omitted. A pair of rolling mount devices slidably couples pontoon module 24 with camper module 26. The pair of rolling mount devices includes pair of channel members 98A and 98B attached to top side 99 of pontoon module 24, and pair of guide members 100A and 100B attached to bottom side 101 of camper module 26. Pair of guide members 100A and 100B are supported by and configured to roll along pair of rollers 102A and 102B.

When positioned in a body of water, flotation members 40 allow pontoon module 24 to float, keeping pontoon platform 38 raised above the body of water. Motor control assembly 41 coupled to pontoon module 24 provides a means for driving multipurpose recreational assembly 20B.

Figure 9:
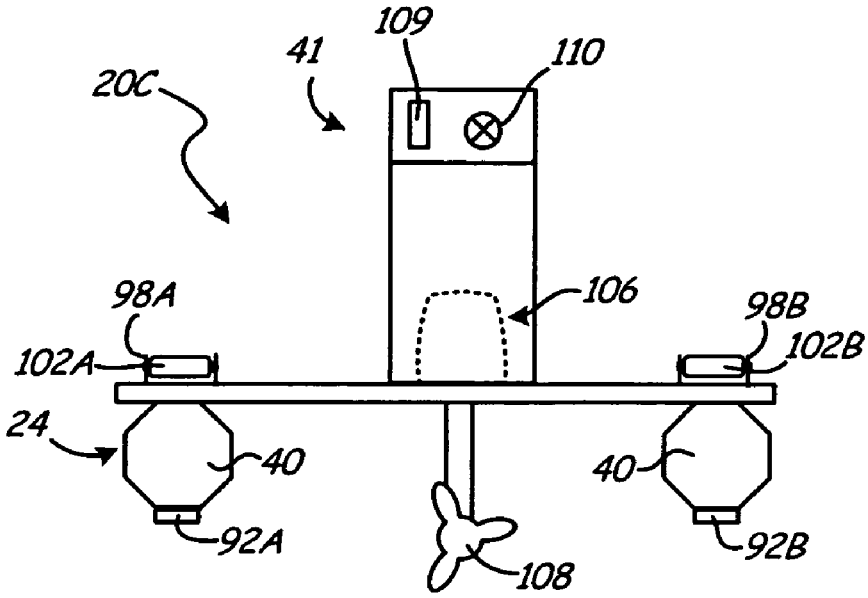
FIG. 9 is a rear view of the multipurpose recreational assembly transformed into a pontoon boat configuration.

FIG. 9 is a rear view of the multipurpose recreational assembly of the present invention transformed into a pontoon boat configuration. In particular, multipurpose recreational assembly 20C represents the embodiment of FIG. 1 with trailer module 22 and camper module 26 omitted. Multipurpose recreational assembly 20C consists generally of pontoon platform 38, flotation members 40, and motor control assembly 41.

Once again, flotation members 40 allow pontoon module 24 to float in a body of water. Motor control assembly 41, which includes outboard motor 106, propeller 108, motor controls 109, and steering wheel 110, is coupled to pontoon platform 38. Motor control assembly 41 provides a means for driving multipurpose recreational assembly 20C in the body of water. Motor 106 is preferably designed with tilt trim to enable motor control assembly 41 to raise propeller 108 closer toward pontoon platform 38 while motor 106 is not in use. In addition, steering wheel 110. allows the operator to maneuver multipurpose recreational assembly 20C while in the body of water.

Figure 10:
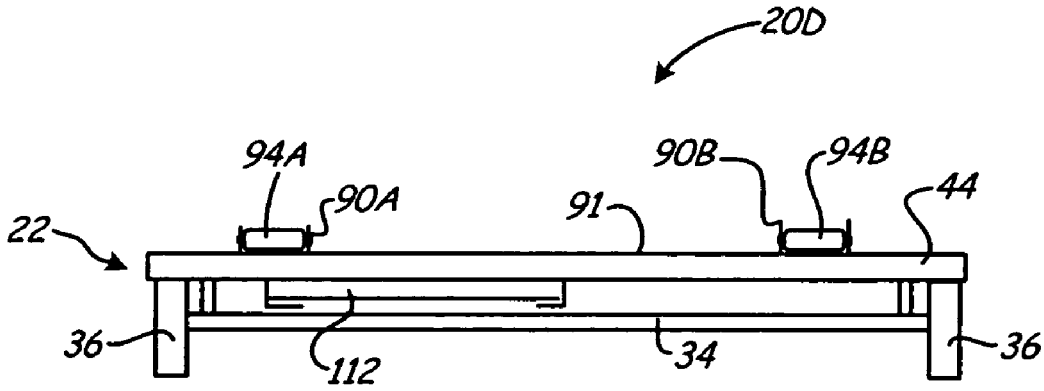
FIG. 10 is a rear view of the multipurpose recreational assembly transformed into a flatbed trailer configuration.

FIG. 10 is a rear view of the multipurpose recreational assembly of the present invention transformed into a flatbed trailer configuration. In particular, multipurpose recreational assembly 20D is the multipurpose recreational assembly of FIG. 1 with pontoon module 24 and camper module 26 omitted. In the flatbed trailer configuration, multipurpose recreational assembly 20D is especially useful for hauling material or transporting recreational vehicles, such as snowmobiles. As shown in FIG. 10, ramp 112 is removably secured to a bottom of trailer platform 44. When extended from underneath trailer platform 44, ramp 112 creates an inclined walkway up to trailer platform 44. Ramp 112 is also configured to allow both the loading and unloading of snowmobiles or other recreational vehicles.

Figure 11:
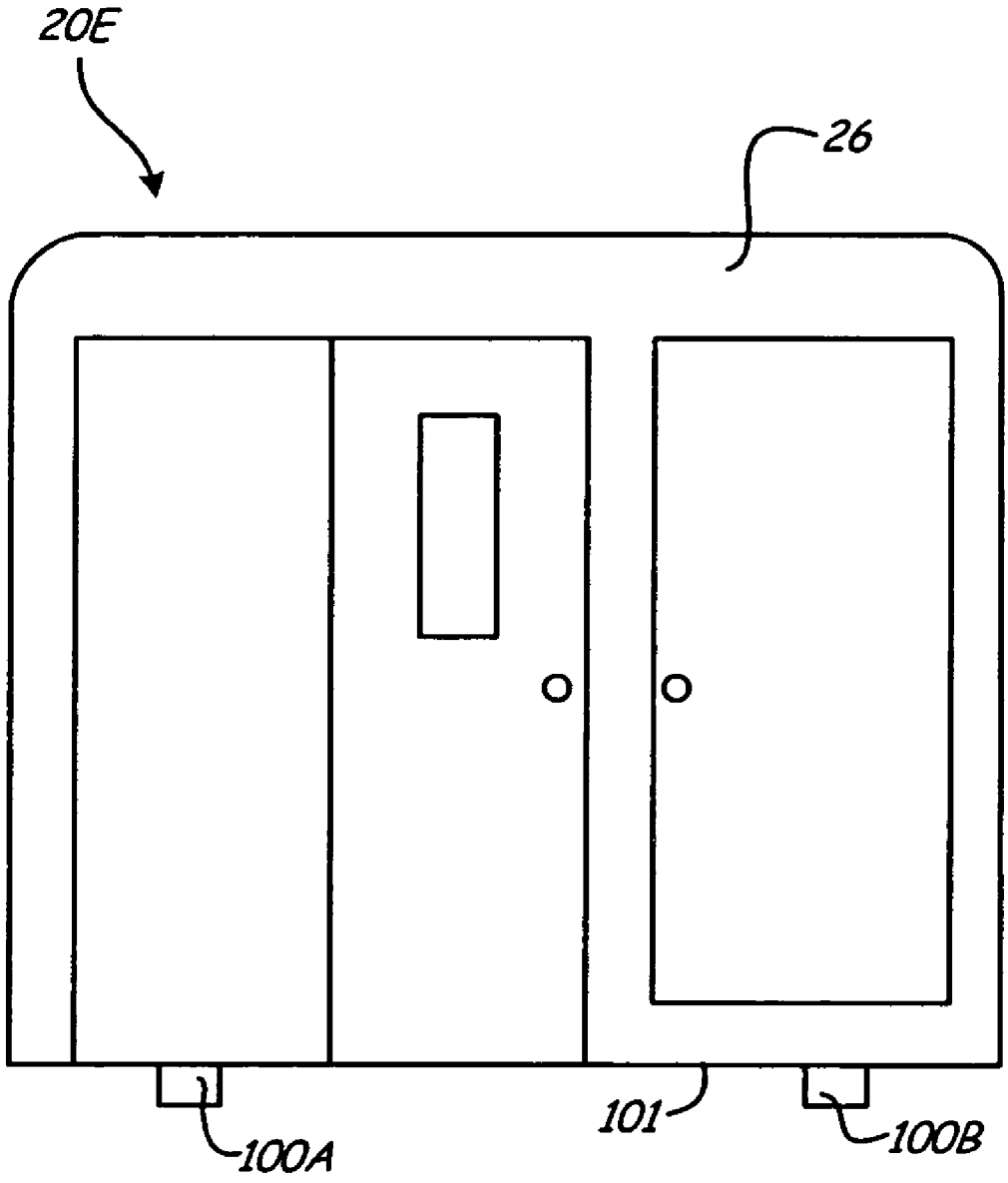
FIG. 11 is a rear view of the multipurpose recreational assembly transformed into an icehouse configuration.

FIG. 11 is a rear view of the multipurpose recreational assembly of the present invention transformed into an icehouse configuration. In particular, multipurpose recreational assembly 20E is the multipurpose recreational assembly of FIG. 1 with trailer module 22 and pontoon module 24 omitted. As shown in FIG. 11, unloading camper module 26 from both pontoon module 24 and trailer module 22 results in a standalone, fully-enclosed structure. Pair of guide members 100A and 100B are configured to slide on snow or ice, and therefore enable a fisherman to pull or push multipurpose recreational assembly 20E to a desired location.

In one embodiment, multipurpose recreational assembly 20E includes a heating source configured to transfer heat into guide members 100A and 100B. When used in the icehouse configuration, ice may form around guide members 100A and 100B, thereby inhibiting movement of multipurpose recreational assembly 20E. This commonly occurs when a layer of ice upon which guide members 100A and 100B are resting melts and then re-freezes. As a result, ice build-up around guide members 100A and 100B prevents any further movement of multipurpose recreational assembly 20E until the ice build-up is removed. By heating guide members 100A and 100B, any ice build-up is melted away, allowing multipurpose recreational assembly 20E to freely slide along the ice once again. In one embodiment, a furnace unit within camper module 26 is configured to direct heat into guide members 100A and 100B. This furnace serves the purpose of both heating an interior of camper module 26 as well as guide members 100A and 100B.

Figure 12:
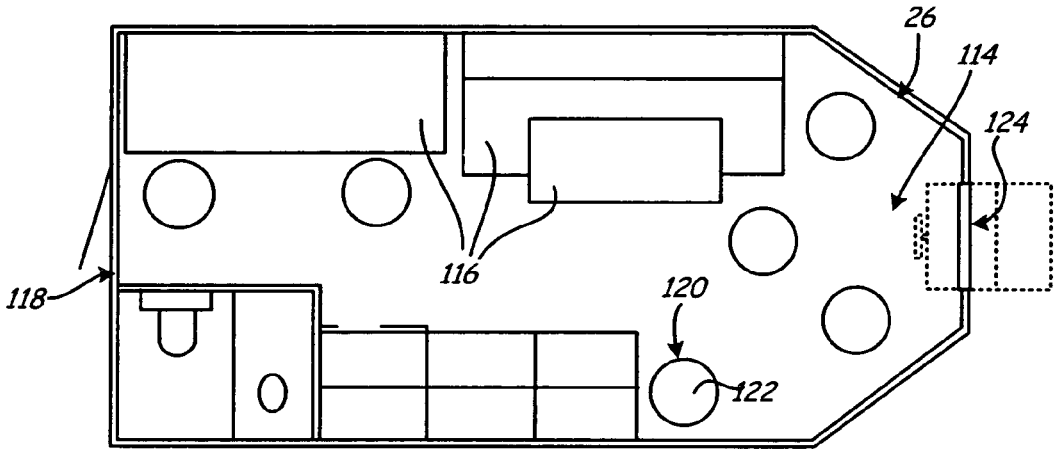
FIG. 12 is a top view of a preferred embodiment of a camper module interior.

FIG. 12 is a preferred embodiment of camper module 26 of the present invention. Specifically, FIG. 12 shows a top view of interior 114 of camper module 26. Interior 114 contains a plurality of furniture elements 116 removably attached to camper module 26. Furniture elements 116 are typically removed from interior 114 through doorway 118. Once furniture elements 116 are removed, camper module 26 has an increased amount of open space in interior 114 for hauling or storage.

FIG. 12 also shows a plurality of ice fishing holes 120 on bottom side 101 of camper module 26. When not in use, ice fishing holes 120 include removable lids 122 to cover the holes and provide a generally flat interior floor throughout interior 114 of camper module 26.

In addition, as shown in FIG. 12, camper module 26 includes removable panel 124. When removed from camper module 26, panel 124 allows motor controls 109 and steering wheel 110 to be positioned inside camper module 26 to provide an enclosed driving position when the multipurpose recreational assembly is transformed into the houseboat configuration shown and described in reference to FIG. 8. When the multipurpose recreational assembly is transformed into the camper configuration. shown and described in reference to FIG. 7, panel 124 is reattached to camper module 26.

Those skilled in the art will recognize that deviations from the structures of the embodiments shown and described herein may be used in practice of the present invention. For example, although the above discussion focused on a multipurpose recreational assembly that includes a trailer module, a pontoon module, and a camper module, an assembly that utilizes different types or combinations of modules is within the scope of this invention. Additionally, one skilled in the art would understand that any multipurpose recreational assembly comprising two or more modules could incorporate the rolling mount devices of the present invention.

Thus, although the present invention has been described with reference to preferred embodiments, workers skilled in the art will recognize that changes may be made in form and detail without departing from the spirit and scope of the invention.

The invention claimed is:

1. A multipurpose recreational assembly comprising:

a trailer module having a trailer platform on a top side and a wheel assembly on a bottom side;

a first pair of channel members spaced by a track width and mounted to the top side of the trailer platform, wherein the first pair of channel members each comprise a first side and a second side extending longitudinally along the trailer module;

a second module having a top side and a bottom side;

a first pair of guide members attached to and projecting downward from the bottom side of the second module, wherein the first pair of guide members are spaced by the track width so that the first pair of guide members is insertable in the first pair of channel members to couple the first pair of guide members with the first pair of channel members; and a first plurality of rollers positioned between the first side and the second side of the first pair of channel members to allow the first or a second pair of guide members to roll along a longitudinal length of the first pair of channel members;

a second pair of channel members mounted to the top side of the second module and space by the track width of the first pair of channel members, wherein the second pair of channel members each comprise a first side and a second side extending longitudinally along the second module;

a third module having a top side and a bottom;

the second pair of guide members spaced substantially by the track width and attached to and projecting downward from the bottom side of the third module, wherein the second pair of guide members is insertable in either the first or the second pair of channel members to couple the second pair of guide members with either the first pair of channel members to mount the third module on the trailer module or the second pair of channel members to mount the third module on the second module with the second pair of channel members; and a second plurality of rollers positioned between a first side and a second side of the second pair of channel members to allow the first or second pair of guide members to roll along a longitudinal length of the second pair of channel members.

2. The multipurpose recreational assembly of claim 1, wherein the second module is a pontoon module.

3. The multipurpose recreational assembly of claim 1, wherein the wheel assembly of the trailer module comprises a first axle and a first set of wheels.

4. The multipurpose recreational assembly of claim 1, wherein a ramp is removably secured to the trailer platform.

5. The multipurpose recreational assembly of claim 1, wherein the trailer module further comprises a frame coupled to the wheel assembly, and wherein the trailer platform is tiltable with respect to the frame.

6. The multipurpose recreational assembly of claim 1, wherein the trailer module further comprises a winch secured to the frame, the winch being attachable to the second module to assist in rolling the first pair of guide members along the first pair of channel members.

7. The multipurpose recreational assembly of claim 1, wherein the third module comprises a camper module having a sleeping quarters and a living quarters and a furnace unit, wherein the camper module is capable of an icehouse configuration with ice fishing holes through the bottom side covered with removable lids and the second pair of guide members are configured to slide on ice and snow.

8. The multipurpose recreational assembly of claim 7, and further comprising a plurality or furniture elements removably attached to an interior of the camper module.

9. The multipurpose recreational assembly of claim 7, and further comprising a steering wheel and a motor control coupled to the pontoon module and configured to be positioned within the camper module.

10. A multipurpose recreational assembly comprising:

a trailer module having a trailer platform on a top side and a frame and a wheel assembly coupled to the frame on a bottom side;

a first pair of channel members spaced by a track width and mounted to the top side of the trailer platform, wherein the first pair of channel members each comprise a first side and a second side running generally parallel to each other and extending longitudinally along the trailer platform;

the trailer platform and an entire longitudinal length of the first pair of channel members are tiltable with respect to the frame;

a camper module having a top side and a bottom side and a sleeping and a living quarters with furniture elements, a furnace unit, a rearward opening door and forward facing window units;

a first pair of guide members attached to and projecting downward from the bottom side of the camper module, wherein the first pair of guide members are spaced by the track width so that the first pair of guide members or a second pair of guide members is insertable in the first pair of channel members to couple the first pair or second pair of guide members with the first pair of channel members and allow the first pair or second pair of guide members to be slidable along the first pair of channel members;

a pontoon module configured to be disposed between the trailer module and the camper module has a pair of flotation members attached to a bottom side thereof;

the second pair of guide members spaced substantially by the track width and attached to and projecting downward from the bottom side of the pair of flotation members, wherein the second pair of guide members is insertable in the first pair of channel members to couple the second pair of guide members with and allow the second pair of guide members to be slidable along the first pair of channel members; and a second pair of channel members mounted to a top side of the pontoon module and spaced apart by the track width, wherein the second pair of channel members each comprise a first side and a second side running generally parallel to each other and extending longitudinally along the pontoon module;

wherein the first pair of guide members attached to the camper module are spaced by the track width so that each of the first pair of guide members is insertable in the second pair of channel members to couple the first pair of guide members with the second pair of channel members and allow the first pair of guide members to be slidable along the second pair of channel members.

11. The multipurpose recreational assembly of claim 10, wherein the first pair of channel members further comprises a plurality of rollers positioned between the first side and the second side to allow the first pair of guide members to roll longitudinally along the first pair of channel members.

12. The multipurpose recreational assembly of claim 10, and further comprising:

a first plurality of rollers positioned between the first side and the second side of the first pair of channel members to allow the second pair of guide members to roll longitudinally along the first pair of channel members; and a second plurality of rollers positioned between a first side and a second side of the second pair of channel members to allow the first pair of guide members to roll longitudinally along the second pair of channel members.

13. The multipurpose recreational assembly of claim 10, wherein the trailer platform further comprises a winch mechanism attachable to the pontoon module and the camper module.

14. The multipurpose recreational assembly of claim 10, wherein the first pair of guide members is configured to receive heat from the furnace unit.

15. A multipurpose recreational assembly comprising:

a first platform having a top side and a bottom side;

a first pair of channel members spaced by a track width and mounted to the top side of the first platform, wherein the first pair of channel members each comprise a first side and a second side extending longitudinally along the first platform;

a second platform having a top and bottom side;

a second pair of channel members mounted to the top side of the second platform and spaced by the track width, wherein the second pair of channel members each comprise a first side and a second side extending longitudinally along the second platform;

a first pair of guide members attached to and projecting downward from the bottom side of the second platform are spaced by the track width so that each of the first pair of guide members is insertable in the first pair of channel members to couple the first pair of guide members with the first pair of channel members;

an enclosure having a top side and a bottom side, a sleeping and a living quarters with furniture elements, a furnace unit, a rearward opening door and forward facing window units; and a second pair of guide members spaced apart by the track width and attached to and projecting downward from the bottom side of the enclosure, wherein each of the second pair of guide members is insertable in one of the first or second pair of channel members to couple the second pair of guide members with either the first pair of channel members to mount the enclosure on the first platform or the second pair channel members to mount the enclosure on the second platform.

16. The multipurpose recreational assembly of claim 15, and further comprising:

a plurality of rollers positioned between the first side and the second side of the first and second channel member to allow the guide member to roll along a longitudinal length of the first and second channel member.

17. The multipurpose recreational assembly of claim 16, wherein the first and second channel member includes a sensor configured to detect when the guide member has reached a predetermined location along the channel member.

18. The multipurpose recreational assembly of claim 16, and further comprising a locking means configured to prevent movement of the guide member relative to the first and second channel member.

19. A multipurpose recreational assembly comprising:

a trailer module having a trailer platform and a wheel assembly;

a first pair of channel members mounted to a top side of the trailer platform and spaced by a track width, wherein the first pair of channel members each comprise a first side and a second side running generally parallel to each other and extending longitudinally along the trailer module;

a pontoon module;

a pair of flotation members attached to a bottom side of the pontoon module;

a first pair of guide members attached to and projecting downward from the bottom side of the pair of flotation members wherein the first pair of guide members are spaced by the track width so that the first pair of guide members is insertable in the first pair of channel members to couple the first pair of guide members with the first pair of channel members of the trailer module; and a second pair of channel members mounted to a top side of the pontoon module and spaced by the track width, wherein the second pair of channel members each comprise a first side and a second side running generally parallel to each other and extending longitudinally along the top side of the pontoon module.

20. The multipurpose recreational assembly of claim 19, and further comprising a camper module having a sleeping quarters, a living quarters and a furnace unit, wherein the camper module is capable of an icehouse configuration with ice fishing holes through the bottom side covered with removable lids and the second pair of guide members which are configured to slide on ice and snow or are configured to couple with either the first or the second channel members so that the camper module can be mounted on either the trailer module or the pontoon module, and the pontoon module can be mounted on either the trailer module or the camper module.

21. A multipurpose recreational system comprising:

a trailer module having a trailer platform on a top side and a wheel assembly on a bottom side, the wheel assembly comprises a first axle and a first set of wheels;

a pontoon module having a deck, wherein a pair of flotation members are attached below the deck and a motor control assembly extends from a top side thereof;

a camper module having a sleeping quarters and a living quarters, wherein the camper module is capable of an icehouse configuration with ice fishing holes extending through a bottom side thereof, the holes covered with removable lids; and wherein the trailer module, pontoon module and camper module are configured with mounting members allowing the trailer module, pontoon module and camper module to be detached from one another and operated individually or arranged in various stacked interchangeable mounting configurations including as a houseboat with the camper module mounted atop the pontoon module with the motor control assembly extending into the camper module, as a covered trailer or movable camper with the camper module mounted atop the trailer platform, or as a recreational assembly with the camper module mounted atop the pontoon module which in turn is mounted atop the trailer module.

* * * * *